United States Patent [19]

Mertz et al.

[11] 3,946,994

[45] Mar. 30, 1976

[54] SYSTEM FOR PRODUCING EMULSIONS

[75] Inventors: Richard E. Mertz; Kenneth J. Lissant, both of St. Louis, Mo.

[73] Assignee: Petrolite Corporation

[22] Filed: Apr. 10, 1974

[21] Appl. No.: 459,760

[52] U.S. Cl. ..... 259/7; 259/DIG. 30

[51] Int. Cl.[2] ..... B01F 7/00

[58] Field of Search ..... 259/7, 8, 4, 18, 21, 22, 259/23, 24, 43, 44, 64, 65, DIG. 30; 137/604, 606

[56] References Cited

UNITED STATES PATENTS

| | | | |
|---|---|---|---|
| 3,012,977 | 12/1961 | Wilson et al. | 259/7 |
| 3,268,212 | 8/1966 | Ziselberger | 259/7 |
| 3,546,129 | 12/1970 | Berg et al. | 259/4 |

*Primary Examiner*—Richard E. Aegerter
*Assistant Examiner*—L. Footland
*Attorney, Agent, or Firm*—Emil J. Bednar

[57] ABSTRACT

A system for the continuous production of thixotropic high internal phase ratio emulsions. The system includes supply means providing individual streams of an inverter phase (an emulsifier and external phase), and an immiscible internal phase. These streams are precisely regulated as to a preselected ratio by flow rate controllers which regulate the flow responsively to pressure changes in the supply means. The internal and inverter phases are received at a selected rate and composition within a mixing means which produces the loose comingling of the internal and inverter phases, thereby forming a composition with the desired ratio of the internal phase, emulsifier, and external phase of the desired emulsion. A pumping means moves this composition at the selected rate to an outlet means for passing the resultant emulsion to a subsequent utilization. The pumping means also provides continuous shear sufficient to reduce the effective viscosity of the composition near to that of the inverter phase, but below the inherent shear stability point of the desired emulsion. The pumping means retains only a minor fraction of the emulsion relative to the volumetric capacity of composition movement.

1 Claim, 2 Drawing Figures

EXTERNAL PHASE
EMULSIFIER
INTERNAL PHASE
BLENDER
EMULSION
V
V
11
12
13
14
15
16
17
18
19
20
21
22
23
25
26
27
37
39
46
47
48
49
51

19
20
26
28
29
31
32
33
34
36

SYSTEM FOR PRODUCING EMULSIONS

BACKGROUND OF THE INVENTION

1. Field of the Invention

This invention relates to the preparation of emulsions and more particularly it relates to apparatus for the continuous preparation of high internal phase ratio emulsions.

2. Description of the Prior Art

Various apparatus have been known and employed for the preparation of emulsions, and in the majority of applications, the apparatus was adapted to the preparation of emulsions only in batch unit processing. Some apparatus was proposed for the continuous preparation of emulsions. In such apparatus, the proportioning of the internal and external phases required precise metering devices, such as positive displacement metering pumps, and sophisticated controls to insure that these pumps delivered the proper ratio of internal and external phases. Then, the two precisely metered internal and external phases were passed to some type of a premixing device which produced a loose dispersion of the internal phase within the external phase. Then, a suitable pump was employed to force the loose dispersion through a mixer which provided the necessary shear for reducing the particle sizes of the internal phase within a continuous external phase, so that the dispersed phase was in droplet sizes of less than a few dozen microns so that a stable emulsion was produced. The mixing device employed elements which could be energized in a fashion that fluids passed between them were commuted to a finally divided state. The mixers can be generally classified as devices capable of producing high shearing, such as high speed impellers, colloidal mills, ultrasonic dispersers, and like machines where the internal phase was subject to high shearing action to be dispersed within the external phase.

Emulsions could be made continuously in such equipment but none of these known apparatus for producing emulsions can produce an emulsion with an internal-external phase ratio in excess of 75 to 25% by volume. First, the properties of these high internal phase ratio emulsions include non-Newtonian flow properties, thixotropic characteristics, and a high sensitivity to shear magnitudes which, if they exceed the stability point of the desired emulsion, cause an inversion between the internal and external phases. For example, emulsions containing 10 to 30% by volume internal phase can be made easily on a continuous or semi-continuous basis. However, as the amount of internal phase begins to rise above the 75% level, the unusual properties of the high internal phase ratio emulsions prevent the ready application of known apparatus for their preparation. One unusual property is the reduction of the effective viscosity of emulsified composition to approximately that of the external phase upon the application of shear. As this condition is approached, the viscosity of the emulsion composition changes rapidly, and this result rapidly changes the flow of the ingredient internal and external phase materials through the various metering and pumping devices. The pumping means may suddenly encounter a change of fluid condition from a relatively low viscosity to a very high viscosity and then suddenly to a reduced viscosity as the desired high internal phase ratio emulsion is obtained. This viscosity changing effect is not the actual viscosity as would be taken in a Fann viscosity meter, but rather is the apparent effective viscosity of the emulsified mass within the system. Reference may be taken to U.S. Pat. No. 3,565,817, where there is a detailed description of the composition preparation and properties of high internal phase ratio emulsions wherein the internal phase is present in excess of 75% by volume of the resultant emulsion. The description of this patent is incorporated herein, along with the additional references listed therein which describe the ingredients and desired emulsions having internal and external phase ratios above 75 to 25% by volume.

The great complexity of suitable known equipment for producing on a continuous basis the high internal phase ratio emulsions may be readily appreciated by reference to the movement and control of the internal and external phase flow streams accomplished by the use of positive displacement rotary vane or gear pumps separately driven and the proportion of the internal phase to external phase controlled by an electronic two component blender which maintains the phase ratio either by adjusting the pump delivery rate or by changing the pump motor speed through an SCR controller or by adjusting a variable volume pump control or maintaining the phase ratio by properly positioning flow control valves in the process stream flow lines. The use of such electronic control requires selective and expensive metering devices to indicate the flow rate to the controller. All of this equipment accomplishes the task of providing a variable volume and controlled proportion of the two liquid streams. None of this equipment is used in producing shear to form the emulsion. Separate emulsifying equipment is provided to mix and emulsify the two streams and thereby produce the desired emulsion. Apparatus of this nature is extremely complicated and demands the utmost in process control features, so that the necessary critical proportioning of the ingredients of the high internal phase ratio emulsion can be obtained. In addition, the actual operation of the mixer providing the necessary shear for producing the emulsion establishes another critical operating parameter in known apparatus. Other apparatus difficulties with these known devices can be readily appreciated by reference to the preceding reference material.

High internal phase ratio emulsions possess peculiar rheological properties. When subjected to sufficiently low rates of shear, they behave like elastic solids. As the rate of shear is increased, a point is reached where they begin to flow. This is referred to as the "yield value". When such emulsions are subjected to increasingly higher rates of shear, they exhibit non-Newtonian behavior, and the effective viscosity decreases rapidly until shear rates in the range of 3,000 to 8,000 reciprocal seconds are reached. In this range the effective viscosity plateaus at a figure close to the viscosity of the external phase. As increasingly higher rates of shear are applied, a point is reached where the emulsifying agents can no longer maintain stable films, and at this point the emulsion breaks and cannot be reconstituted readily. The yield value and shear stability point, as well as the shape of the viscosity versus shear curve, will vary with each particular emulsion formulation.

Thus, in order successfully to prepare high internal phase ratio emulsions continuously, it is necessary to employ an apparatus capable of exerting sufficient shear upon the emulsions so that its viscosity approaches that of the phases, particularly that of the external phase, without causing the emulsion to break.

While the apparatus maintains the high internal phase ratio emulsion in this state, the phases are introduced therein so as to produce the emulsion on a continuous basis.

SUMMARY OF THE INVENTION

In accordance with this invention, there is provided a system for producing at a selected rate of stable, highly viscous emulsion with an internal phase content of at least 75% by volume within an immiscible external phase. Supply means provide individual streams of an inverter phase (formed of an internal-in-external emulsifier and an external phase), and an internal phase. First and second flow rate controller means precisely regulate, responsively to pressure changes in the supply means, the flow rates of the separate streams of inverter and internal phases, at a preselected ratio in the range between 95 to 5 and 75 to 25% by volume irrespective of the pressure conditions within the system. Mixing means receive the separate streams of internal and inverter phases and commingle them whereby the internal phase is distributed loosely in the inverter phase. As a result, a composition is formed with the desired ratio in separate components of internal phase, emulsifier and external phase of the desired emulsion. Pumping means move the composition of internal phase and inverter phase at the selected rate. The pumping means also provide continuous shear sufficient to reduce the effective viscosity of the composition near to that of the inverter phase but below the inherent shear stability point of the desired emulsion. The pumping means retain only a minor fraction of the emulsion relative to the volumetric movement of the composition which is converted into the emulsion. The pumping means moves the emulsion to an outlet means which passes the resultant emulsion to a subsequent utilization.

DESCRIPTION OF SPECIFIC EMBODIMENTS

Figure 1:
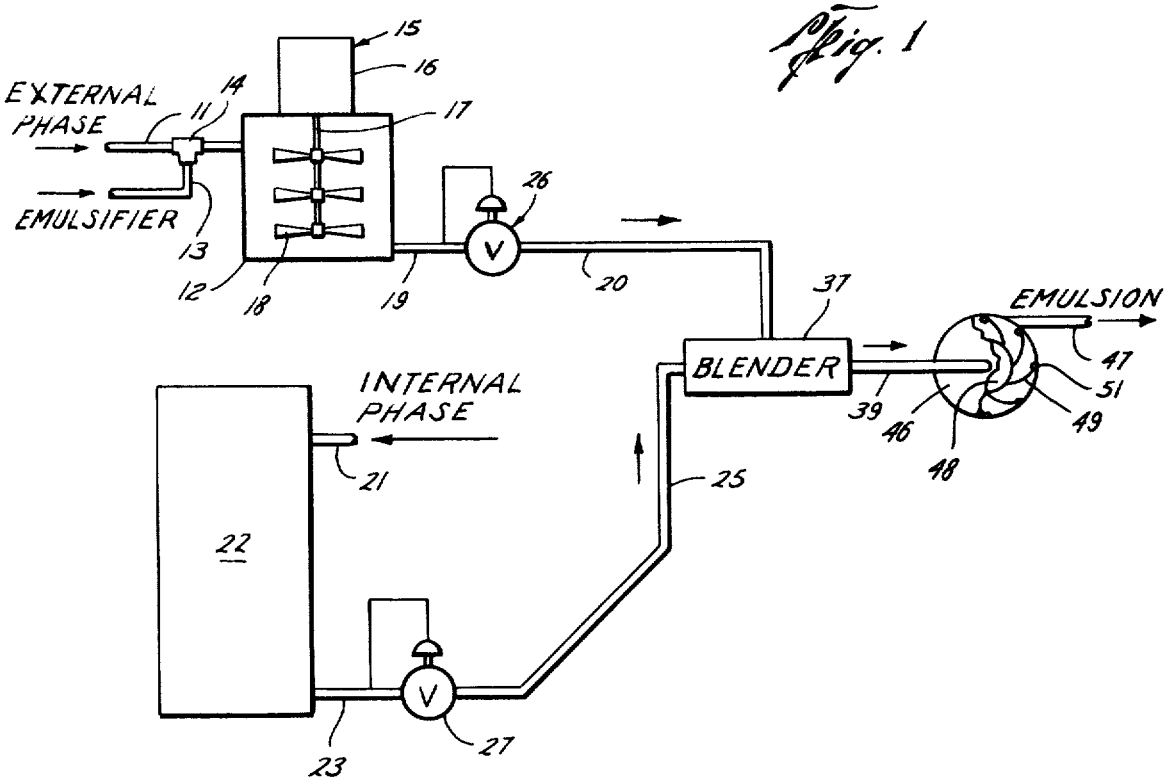
FIG. 1 is a schematic diagram of an apparatus arranged in accordance with the present invention.

Referring to FIG. 1 of the drawings, there is illustrated a system for producing at a selected rate a stable high internal phase ratio emulsion by a unique combination of readily available elements. In the present description, the emulsion will be described as formed by an internal phase dispersed within an immiscible external phase. For this purpose, the emulsion may be formed of a water phase dispersed within an organic liquid, such as hydrocarbons, or it may be formed of an organic liquid, such as hydrocarbons, dispersed within an aqueous phase. Either type of high internal phase ratio emulsion can be produced by the present system. In each instance, the emulsion will include an emulsifier which provides the proper colloidal environment for the dispersion of a selected internal phase within a selected immiscible external phase. For example, if the emulsion is to be formed of a water internal phase within a hydrocarbon external phase, a water-in-oil emulsifier is employed. If the phases are reversed, then a oil-in-water emulsifier is employed. The present system is without limitations as to the particular material forming the internal and external phases and the emulsifier. These materials are well known and many are listed with U.S. Pat. No. 3,565,817, supra.

The present system includes supply means providing individual streams of an inverter phase and an internal phase. For this purpose the external phase liquid may be carried within inlet conduit 11 to a storage vessel 12. An emulsifier is supplied by inlet conduit 13 to the storage vessel 12 and held therein until required in the process. If desired, the inlet conduits 11 and 13 may be joined by a tee 14. In this manner, the vessel 12 receives the desired proporation of the external phase liquid and emulsifier. The emulsifier will usually be present in amounts of about 1 to 25% by volume of external phase liquid employed in the present system. If desired, the vessel 12 may carry a mixer for homogenizing the emulsifier in the external phase liquid. For this purpose, a prime mover 16 interconnects with the vessel 12 and carries a depending shaft 17 upon which are mounted a plurality of shear inducing blades 18. Operation of the mixer homogenizes the emulsifier within the external phase liquid thereby forming the separate stream of the inverter phase which is removed from the vessel 12 through the outlet 19. The internal phase may be obtained from any suitable source and is passed through an inlet conduit 21 into a second storage vessel 22 where it is contained until required for the present process. The internal phase is removed from the vessel 22 by an outlet 23. Although the vessels 12 and 22 are shown to be separate storage containers, obviously they may be portions of a mobile system such as barrels or tanks carried on various prime movers, such as four-wheel vehicles, trucks, fire trucks, and other types of mobile containers. Where the system is to be employed within a stationary facility, the vessels 12 and 22 may be more conventional, such as steel tanks mounted on concrete foundations. Other arrangements will be apparent for providing suitable storage containers for the system depending upon the particular implacement desired.

Figure 2:
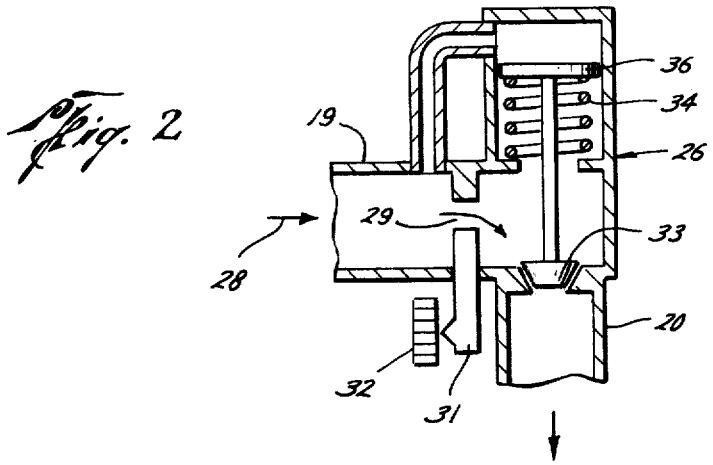
FIG. 2 is a partial sectional view of a flow rate controlling valve employed in the apparatus of FIG. 1.

The flow rates of the separate streams of the internal and inverter phases are precisely regulated in response to pressure changes in the supply sources. For example, the pressure changes within the outlet conduits 19 and 23 may be employed for precisely regulating the flow rates of these phases. In particular, the outlet conduit 19 contains a flow rate controller 26 while the outlet conduit 23 contains a flow rate controller 27. These flow rate controllers are of a specific type which combine the operation of an adjustable orifice and automatic internal regulating valve. These flow rate controllers are commercially available as Kates Automatic Flow Rate Controllers, although other equivalent flow controllers may be used. Broadly, flow rate controllers 26 and 27 can be preset to provide a particular fixed flow rate for inverter and internal phases and will maintain this precise flow rate irrespective of changes in pressure in the outlet conduits 19 and 23 or elsewhere in the present system. The functioning of the flow rate controllers may be appreciated by momentary reference to FIG. 2 where a flow rate controller is illustrated in diagrammatical fragmentary sectional view. The flow rate controller is connected within the outlet conduit 19 and receives a flow of fluid indicated by the arrows 28. The flow rate controller 26 has an adjustable orifice 29 which is provided by cooperation of an arcuate slot carried upon a movable sleeve 31. The sleeve 31 may be positioned relative to the scale indicia 32 to provide any desired orifice 29 to establish a predetermined or preselected flow rate for the particular phase to be regulated above a certain minimum pressure change. Fluid flows through the orifice 29 and passes a regulating valve 33 to outlet conduit 20 in amounts determined by the clearance between the valve 33 and the body of the flow controller 26. This opening or clearance is regulated by a balancing action between a biasing spring 34 and the application of a pressure differential across the orifice 29 applied to a piston 36 carried upon the upper end of the valve 33. A change in pressure differential across the orifice 29 will cause a reflective pressure change above the piston 36. The valve member opens upon a decreasing pressure differential and closes upon an increasing differential. Thus, a pressure rise or fall causes the valve 33 to move the maintain a fixed rate of flow through the outlet conduit 19. Thus, the valve 33 is positioned relative to the body of the flow controller 26 by a hydraulic force balanced by the pressure differential across the orifice 29. This force balancing action maintains constant differential pressure across orifice 29 and hence maintains constant the flow rate determined by the size of the orifice by the responsive movement of the valve 33. Other types of flow rate controllers may be employed if desired which are capable of producing an equivalent function.

The flow rate controllers 26 and 27 are adjusted so that inverter phase flowing in outlet conduit 19 into outlet conduit 20 and internal phase flowing thru outlet conduit 23 into outlet conduit 25 have the desired ratio of the ultimate emulsion to be prepared. For example, the controllers are preset by adjustment of the sleeve 31 so that the flow rate of the separate streams of inverter phase and the internal phase are in a preselected ratio in the range of between 95 to 5 and 75 to 25% by volume which can be maintained irrespective of the pressure conditions within the system. The separate streams of the internal phase and the inverter phase are passed through a distributor or blender 37 which provides a mixing function whereby the internal phase is loosely distributed in the inverter phase. The blender 37 is a simple flow line mixer in which liquids are commingled into a loose mixture with low levels of shear and mixing energy, and very small contact time. A simple pipe tee can provide the blender 37 and other types of flow line mixers could be used. This mixing function in blender 37 does not produce the desired emulsion, but rather provides a commingling of the separate streams as by side-by-side stream line flows into the substantially uniform composition in outlet 39 which can be subject to shear to form the desired emulsion. The blender 37 joins these streams under the fixed ratio condition provided by the flow rate controllers 26 and 27. Movement of these fluids from left to right within the blender 37 causes the internal phase to be introduced substantially uniformly in commingling with the inverter phase before reaching the outlet 39. As a result, the mixture of the internal phase within the inverter phase in the outlet 39 provides a composition with the desired ratio of internal phase, emulsifier and external phase of the desired emulsion. However, this distribution of fluids is unstable and would readily separate if allowed to remain under steady state conditions.

In the present system, this loosely commingled composition is passed to a unique element which produces the desired emulsion. The outlet 39 of the blender 37 connects to a centrifugal or radial flow pump. This pump provides several functions within the present system. First, the pump 46 powered by suitable prime mover causes the flow of fluids through the system and into an outlet 47. Thus, the pump 46 provides the operating force for the operation of the flow rate controllers 26 and 27 and also for the operation of the blender 37 in distributing the internal phase within the inverter phase and forms the loosely commingled composition which is ultimately converted into the desired emulsion. In this manner, the pump 46 determines the rate at which the desired emulsion is produced in the present system. As previously mentioned, the ratio of the inverter and internal phases is predetermined by operation of flow rate controllers 26 and 27 irrespective of the pressure conditions within the system. Second, the pump 46 provides continuous shear sufficient to reduce the effective viscosity of the composition delivered at outlet 39 to near that of the inverter phase. However, the pump 46 should not produce such excessive amounts of shear that the inherent shear stability point of the desired emulsion is exceeded causing a reversion or breaking of the emulsion. Third, the pump 46 should retain only minor fractions (e.g., 1% vol.) of the desired emulsion relative to the volumetric flow rate of the composition being provided from the blender 37.

Although various types of pumps 46 may be employed in the present system, rotary impeller pumps are preferred, and in particular, impeller pumps with rubber rotating members are exceptional in performance. For example, the pump 46 may be a Jabsco rubber impeller pump which is commercially available. This type of pump contains a rotating member 48 carried within its body, and this member carries a plurality of radially extending vanes 49 having an enlarged round tip portion 51. As the pump member 48 rotates, the vanes 49 are radially distended causing the round tip portion 51 to form a substantially effective seal against the body of the pump 46. In addition, the magnitude of shear exerted by the pump 46 upon the composition is sufficient to create the desired emulsison removed through the outlet 47. Usually, the pump 46 is arranged to provide shear rates which should not exceed approximately 10,000 reciprocal seconds which magnitude would cause many high internal phase ratio emulsions to be reverted or broken. Usually, the pump 46 will provide a minimum shear magnitude of about 500 reciprocal seconds. Additionally, the pump must have a prime move of sufficient power to assure maintaining minimum suction on the flow controllers. Reference to U.S. Pat. No. 3,565,817 will define these operating parameters for the pump 46. Literature is available with various types of pumps and will readily define those that can be employed in the present invention in accordance with the preceding operating parameters that have been defined. The desired emulsion provided by the pump 46 is removed through the outlet 47 and carried to the subsequent utilization.

The subsequent utilization of the emulsions provided by the present system finds many uses in the pharmaceutical, food, cosmetic and firefighting industries. For example, it has been found that high internal phase ratio emulsions wherein the ratio of water phase to a hydrocarbon phase of about 95 to 5 percent by volume produces an exceptional firefighting fluid. A 600-gallon per minute field unit constructed according to the present system can be mounted upon a fire truck and operated in conjunction therewith. The external phase is provided by a hydrocarbon distillate such as plate spray oil into which is blended a water-in-oil emulsifier.

The flow rate controller is adjusted to provide a rate of flow of the resultant inverter phase of 30 gallons per minute. Water is the internal phase and is supplied by the flow rate controller at 570 gallons per minute. These phases are passed to a blender 37 which is formed within a 4-inch pipe having a length of approximately 1½ feet and a side inlet for the distillate. A pump providing for the movement of fluids and the necessary shearing action converts the resultant composition into 600 gallons per minute of high internal phase ratio emulsion. This emulsion falls within the present system and has the effective viscosity of the inverter phase at moderate shear. However, on application through a firefighting nozzle upon a combustible structure, the emulsion obtains the appearance of mayonnaise or white shaving lather. The emulsison becomes very tenacious and adheres to the combustible structure, sticking to every presented surface, including those rearwardly of the direction of application, and effectively extinguishs and prevents combustion of the protected structure. Only the unique system of the present invention can be employed on a continuous basis to provide the necessary large quantities of such emulsions needed to combat fires. Complex continuous apparatus for preparing emulsions such as employed in the past are entirely unsuited for such usage. The present system avoids the difficult and sensitive controls needed for precise metering and pumping mechanisms and in the operating of high shear mixing and emulsification devices, which have led in the past to complex sensitive, nonportable and difficult to operate continuous emulsification systems. The present system is an invention which avoids all of these problems encountered by known continuous emulsification apparatus.

Various modifications and alterations in the described system will be apparent to those skilled in the art which do not depart from the spirit of the present invention. For this reason, these changes are desired to be included within the scope of the appended claims. The appended claims define the present invention; the foregoing description is to be employed for setting forth the present system.

What is claimed is:

1. A system for producing at a selected rate a stable, highly viscous emulsion with an internal phase content of above about 75% by volume within an immiscible external phase comprising:

a. supply means providing individual streams of an inverter phase formed of water-in-oil emulsifier and a hydrocarbon phase, and a water phase;

b. first and second flow rate controller means each having a regulating valve automatically adjusted by pressure differential across an orifice in each stream for precisely regulating responsively to pressure changes in said supply means the flow rates of separate streams of the water phase and the inverter phase in a preselected ratio in the range of between 95 to 5, and 75 to 25% by volume irrespective of the pressure conditions within said system above a certain minimum pressure change;

c. mixing means receiving the separate streams of the water phase and the inverter phase and mixing said streams under the preselected ratio condition wherein the water phase is distributed loosely in the inverter phase, thereby forming a composition with the desired ratio of water phase, emulsifier and hydrocarbon phase of the desired emulsion;

d. pumping means;

e. means for passing said composition of water phase and inverter phase into said pumping means for moving therethrough said composition at the selected rate;

f. said pumping means providing continous shear at rates between about 500 and 10,000 reciprocal seconds sufficient to reduce the effective viscosity of said composition near to that of the inverter phase but below the inherent shear stability point of the desired emulsion; said pumping means retaining less than 1% by volume of said emulsion relative to the volume per minute of said composition being moved; and g. outlet means for removing the resultant emulsion from said pumping means to a subsequent utilization.

* * * * *